US011082774B2

(12) United States Patent
Miehl et al.

(10) Patent No.: US 11,082,774 B2
(45) Date of Patent: Aug. 3, 2021

(54) BOTTOM PORTED MEMS MICROPHONE WITH ADDITIONAL PORT FOR VERIFICATION OF ENVIRONMENTAL SEAL

(71) Applicant: MOTOROLA SOLUTIONS, INC., Chicago, IL (US)

(72) Inventors: Andrew P. Miehl, Boca Raton, FL (US); Deborah A. Gruenhagen, Southwest Ranches, FL (US); Geng Xiang Lee, Penang (MY); Karl F. Mueller, Sunrise, FL (US)

(73) Assignee: MOTOROLA SOLUTIONS, INC., Chicago, IL (US)

( * ) Notice: Subject to any disclaimer, the term of this patent is extended or adjusted under 35 U.S.C. 154(b) by 0 days.

(21) Appl. No.: 16/725,980

(22) Filed: Dec. 23, 2019

(65) Prior Publication Data

US 2021/0195341 A1 Jun. 24, 2021

(51) Int. Cl.
*H04R 19/04* (2006.01)
*H04R 29/00* (2006.01)
*H04R 1/04* (2006.01)

(52) U.S. Cl.
CPC ..... *H04R 19/04* (2013.01); *H04R 1/04* (2013.01); *H04R 29/004* (2013.01); *H04R 2201/003* (2013.01)

(58) Field of Classification Search
None
See application file for complete search history.

(56) References Cited

U.S. PATENT DOCUMENTS 9,628,929 B2 4/2017 Salvia et al.
2014/0318213 A1* 10/2014 Tsao ..... G01N 29/14 73/1.86
2015/0181346 A1* 6/2015 Jingming ..... H04R 1/02 381/114
2016/0360333 A1 12/2016 Higgins et al.

* cited by examiner

*Primary Examiner* — James K Mooney
(74) *Attorney, Agent, or Firm* — Michael Best and Friedrich LLP

(57) ABSTRACT

Methods and systems for verification of an environmental seal provided by an encapsulant coating of a bottom-ported MEMS microphone package. A purposeful acoustic leak is provided on an upper surface of a package housing (in the form of an additional acoustic port) and a sealing material is applied to an outer surface of the package housing. A properly applied encapsulant coating will completely seal the additional acoustic port on the upper surface of the package housing. However, the placement of the additional acoustic port on the upper surface of the package housing will have a significant, detectable effect on the frequency response of the microphone if it is not completely sealed by the encapsulant coating. Accordingly, the environmental seal provided by the encapsulant coating is verified by confirming, based on the acoustic frequency response testing, that the encapsulant coating has effectively sealed the additional acoustic port on the upper surface of the package housing.

19 Claims, 5 Drawing Sheets

BOTTOM PORTED MEMS MICROPHONE WITH ADDITIONAL PORT FOR VERIFICATION OF ENVIRONMENTAL SEAL

BACKGROUND OF THE INVENTION

Micro-electromechanical system ("MEMS") microphone packages include an acoustic port for acoustic waves to enter the package housing where they cause deflections (e.g. vibrations) of a membrane. These deflections cause variations in an electrical signal output of the microphone package indicative of the acoustic wave. In some MEMS microphone packages, the package housing might be at least partially sealed for performance or environmental purposes.

BRIEF DESCRIPTION OF THE SEVERAL VIEWS OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
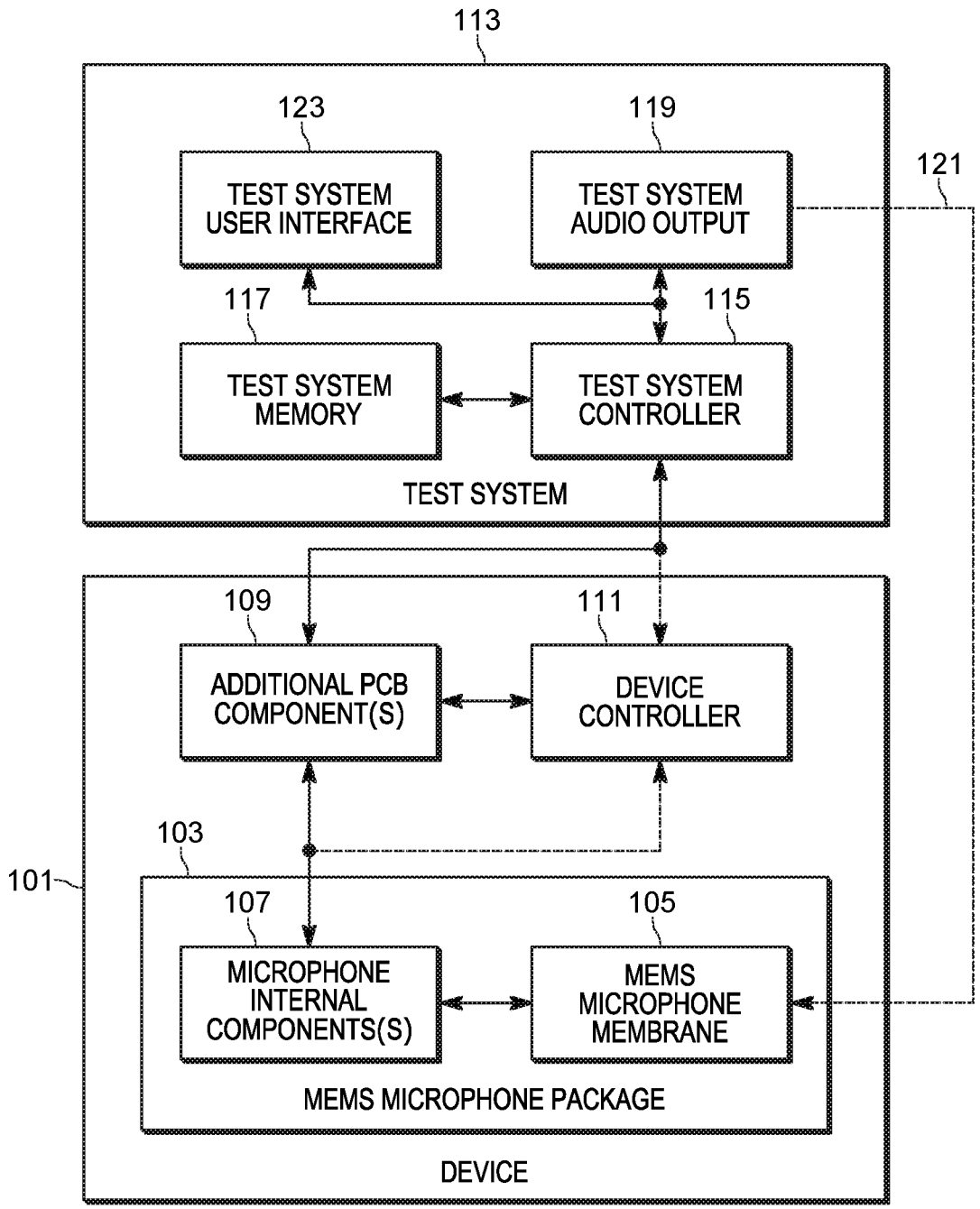
FIG. 1 is a block diagram of an electronic device including a MEMS microphone configured in electronic and acoustic communication, with a test system for verification of acoustic performance and an environmental seal of a package housing of the MEMS microphone.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION OF THE INVENTION

Methods and systems are described in this disclosure for verification of an environmental seal provided by an encapsulant coating of a bottom-ported MEMS microphone package. A purposeful acoustic leak is provided on an upper surface of a package housing and a sealing material is applied to an outer surface of the package housing. A properly applied encapsulant coating will completely seal the purposeful acoustic leak on the upper surface of the package housing. However, the placement of the purposeful acoustic leak on the upper surface of the package housing will have a significant, detectable effect on the acoustic frequency response of the microphone if it is not completely sealed by the encapsulant coating. Accordingly, the environmental seal provided by the encapsulant coating is verified by confirming, based on the acoustic frequency response testing, that the encapsulant coating has effectively sealed the purposeful acoustic leak on the upper surface of the package housing.

In some implementations, this disclosure provides a method of verifying the environmental seal provided by an encapsulant coating applied to a MEMS microphone package by testing the acoustic frequency response to confirm that the encapsulant coating has effectively sealed the purposeful acoustic leak on the upper surface of the package housing. In other implementations, the disclosure provides an electronic device including a bottom-ported MEMS microphone package coupled to a printed circuit board (PCB) and sealed with an encapsulant coating, wherein the bottom-ported MEMS microphone package includes an additional acoustic port formed in an upper surface of a package housing of the MEMS microphone package. The environmental seal provided by the encapsulant coating can be verified by analyzing the frequency response of the bottom-ported microphone package to determine whether the additional acoustic port provides an acoustic leak.

FIG. 1 illustrates an example of an electronic device 101 that includes a MEMS microphone package 103. The MEMS microphone package 103 includes a MEMS microphone membrane 105 and one or more additional microphone internal components 107. The MEMS microphone package 103 is mounted to a printed circuit board (PCB) and, through the printed circuit board, is communicatively coupled to other additional printed circuit board components 109. For example, in some implementations, the MEMS microphone package is coupled to a device controller 111 (e.g., an electronic processor configured to operate the device 101 by executing computer-readable instructions from a non-transitory computer readable memory).

The MEMS microphone package 103 of the device 101 is communicatively coupled to a test system 113 through an audio output component (e.g., additional printed circuit board component 109) configured to output an electrical signal indicative of mechanical deflections/vibrations of the MEMS microphone membrane 105. Alternatively, in some implementations, the electrical output signal may be provided to the test system 113 through the device controller 111 or the test system 113 might be directly coupled to the MEMS microphone package 103 to receive the electrical output signal.

The test system 113 includes a test system controller 115 that is communicatively coupled to a test system memory 117. The test system memory 117 is a non-transitory, computer readable memory configured to store computer-executable instructions that are accessed and executed by the test system controller 115. The test system controller 115 includes, for example, an electronic processor configured to execute the computer-executable instructions from the test system memory 117. The test system controller 115 is also configured to receive the electrical output signal from the MEMS microphone package 103 and to analyze the electrical output signal including, for example, performing an acoustic frequency response testing. In some implementations where the electrical output signal from the MEMS microphone package 103 is received by the test system 113 as an analog signal, the test system controller 115 may also include an analog-to-digital converter to convert the analog electrical output signal into digital data that is then analyzed by the electronic processor of the test system controller 115. In other implementations, the test system 113 includes a separate analog-to-digital converter (not pictured) configured to receive the analog electrical output signal from the MEMS microphone package 103, convert the analog electrical output signal to a digital output signal, and provide the digital output signal to the test system controller 115.

In still other implementations, the test system controller 115 include a signal comparator configured to receive the electrical output signal from the MEMS microphone package 103 and a reference signal (e.g., from a reference signal generator (not pictured)), and to generate an output indicative of a difference between the electrical output signal from the MEMS microphone package 103 and the reference signal.

In the example of FIG. 1, the test system 113 also includes a test system audio output 119 including, for example, a speaker and an amplifier. The test system audio output 119 and the MEMS microphone package 103 are position in proximity to each other such that an acoustic output 121 (e.g., acoustic waves) generated by the test system audio output 119 cause deflection/vibration of the MEMS microphone membrane 105 and the deflection/vibration of the MEMS microphone membrane 105 causes the MEMS microphone package 103 to generate an electrical output signal that is then received & analyzed by the test system controller 115.

In some implementations, the test system 113 also includes a test system user interface 123 including, for example, a display screen and a user input device (e.g., a touch-screen display, a keyboard, a mouse, etc.). In some implementations, the test system controller 115 is configured to initiate and control a testing routine (e.g., acoustic frequency response testing) based on a user input received through the test system user interface 123. The test system controller 115 may also be configured to cause the test system user interface 123 to display output information (e.g., graphically or textually) indicative of the results of the testing procedure performed on the device 101. For example, the test system 113 may be configured to output on the test system user interface 123 a graph of the acoustic frequency response of the MEMS microphone package 103 of the device 101 and/or an indicative of whether the MEMS microphone package 103 of the device 101 has passed a particular testing routine (e.g., whether the acoustic frequency response testing has verified the application of an encapsulant seal to the MEMS microphone package 103 as described in further detail below).

In some implementations, the device 101 may be designed and configured to position the MEMS microphone package 103 on or at a superficial boundary of the device 101 (i.e., an outer layer of environmental exposure). This placement of the MEMS microphone package 103 reduces length/distance of the acoustic path within the device 101 and thereby reduces undesirable acoustic resonances. This preserves a flat, wide-band acoustic sensitivity of the MEMS microphone package 103 that is beneficial, for example, for speech recognition and noise cancellation applications. However, placement of the MEMS microphone package 103 as close as possible to an exposed outer surface of the device 101 seemingly conflicts with the need to protect the MEMS microphone from environmental factors such as, for example, water ingress. Such remote mounting requirements make it difficult for the superficial boundary of the device 101 to protect the body of the MEMS microphone package 103 and any peripheral electrical components (e.g., additional printed circuit board component(s) 109) from environmental exposure. And so, in some implementations, this protection is provided instead, by applying a sealing material to an exterior surface of the MEMS microphone package 103 to encapsulate the MEMS microphone package 103 in a protective encapsulant.

Figure 2A:
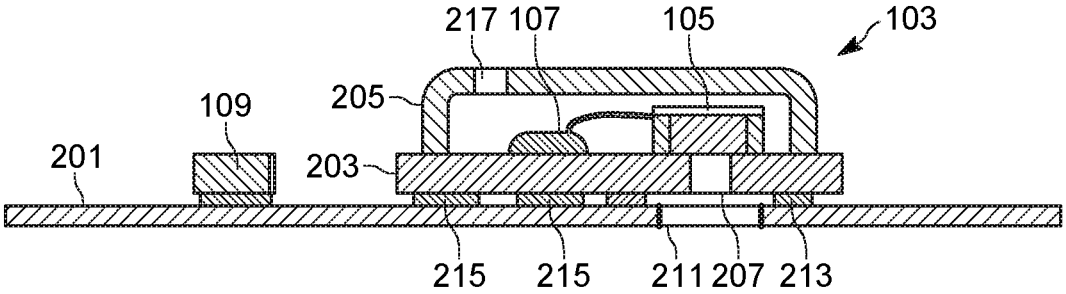
FIG. 2A is a cross-sectional elevation view of the MEMS microphone package of the device of FIG. 1 mounted on a printed circuit board (PCB) prior to application of an encapsulant material.

FIG. 2A illustrates an example of a MEMS microphone package 103 mounted on a printed circuit board (PCB) 201. The MEMS microphone package 103 includes a base substrate 203 and a microphone enclosure (i.e., cap 205) that together form a package housing. The MEMS microphone membrane 105 and one or more additional microphone semi-conductor/electrical circuit components (e.g., the microphone internal components 107) are mounted on the base substrate 203. The mounted position of the MEMS microphone transducer structure (i.e., the structure supporting the MEMS microphone membrane 105) is proximate a primary acoustic port 207 formed through the base substrate 203 so that acoustic pressures entering through the primary acoustic port 207 excites a MEMS microphone membrane 105 causing deflection/vibration of the MEMS microphone membrane 105. Similarly, the MEMS microphone package 103 is mounted on printed circuit board 201 proximate to an acoustic port opening 211 formed through the printed circuit board 201 such that the acoustic pathway to the MEMS microphone membrane 105 passes through the acoustic port opening 211 of the printed circuit board 201 and through the primary acoustic port 207 of the MEMS microphone package 103. Solder connections 213 couple the base substrate 203 to the printed circuit board 201 and, in some implementations, establish an acoustic seal around the primary acoustic port 207 between the base substrate 203 and the printed circuit board 201.

The MEMS microphone package 103 is communicatively coupled to other electrical components on the printed circuit board 201 (e.g., additional printed circuit board component 109) by one or more solder bond points 215 coupling electrical circuit output pads of the MEMS microphone package 103 to printed electrical traces on the printed circuit board 201 that extend to electrical contact pins of the other electrical components on the printed circuit board 201.

Figure 2B:
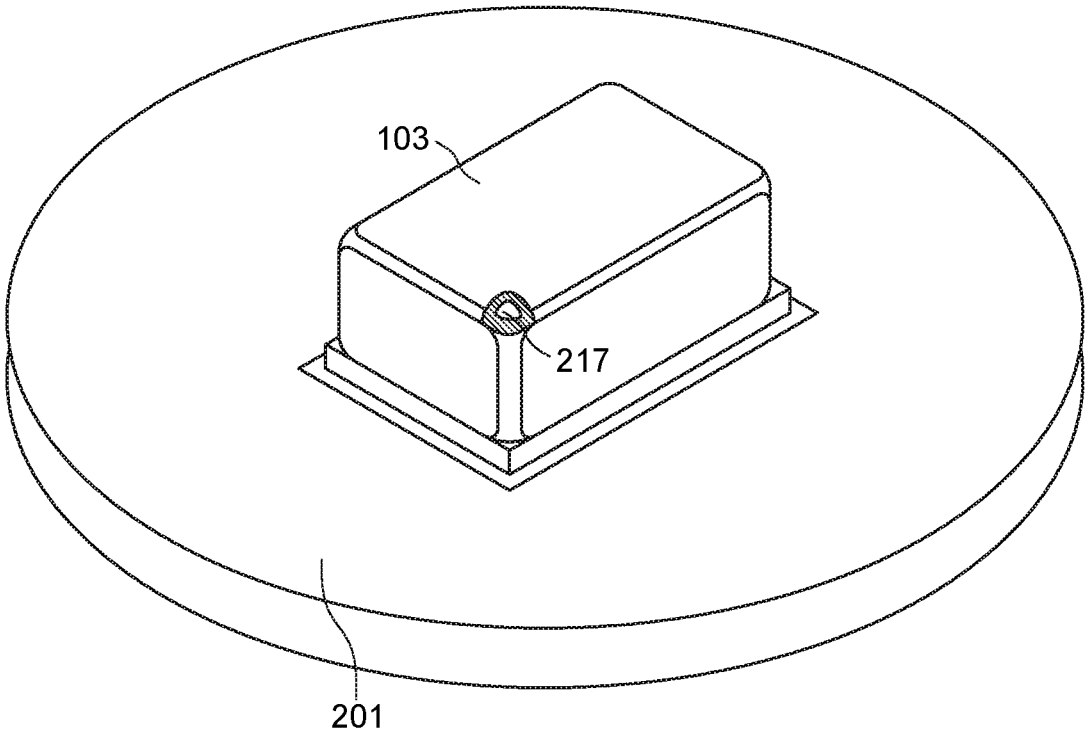
FIG. 2B is a perspective view of the MEMS microphone package of FIG. 2A.

An additional acoustic port 217 is also formed in the cap 205 on an upper surface of the package housing of the bottom-ported MEMS microphone package 103. As discussed in further detail below, the additional acoustic port 217 is a purposeful acoustic leak that is incorporated in the structure of the bottom ported MEMS microphone package 103 for verification testing of an environmental seal. In some implementations, the cap 205 is formed of a continuous solid barrier of sheet metal and serves as the "back-side" acoustic enclosure that tightly establishes the back-volume for the MEMS microphone membrane 105. Accordingly, the creation of the purposeful acoustic leak provided by the additional acoustic port 217 in the package housing will significantly degrade the sensitivity response of the MEMS microphone membrane 105. An example of a purposeful acoustic leak provided by an additional acoustic port 217 formed in the cap 205 portion of the package housing is also illustrated in FIG. 2B.

Figure 2C:
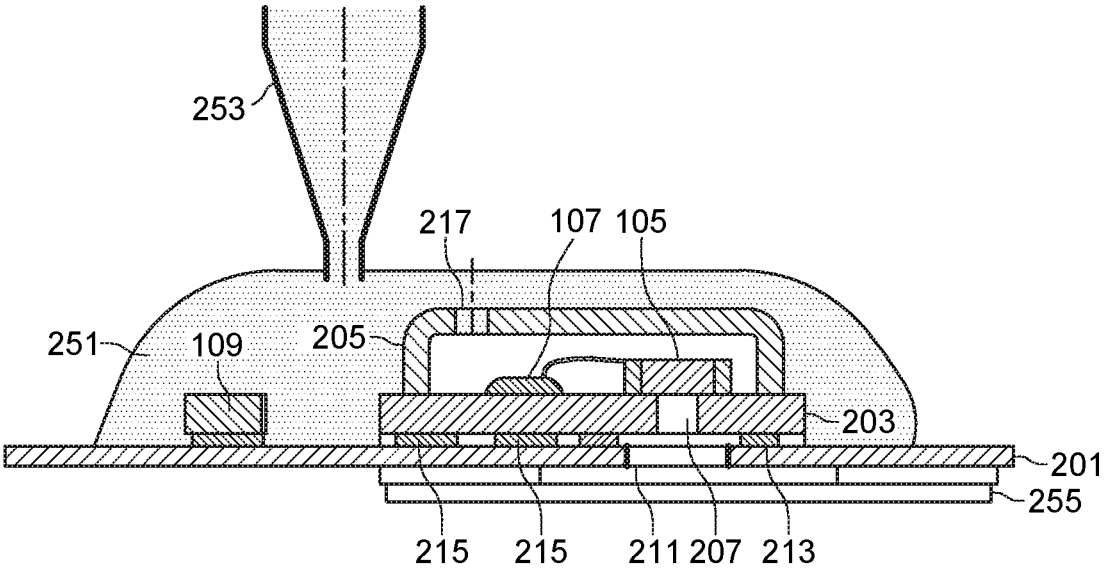
FIG. 2C is a cross-sectional elevation view of the MEMS microphone package of FIG. 2A after application of the encapsulant material.

As illustrated in FIG. 2C, a sealing material 251 is applied to the "backside" surface of the printed circuit board 201 (i.e., the surface of the printed circuit board 201 on which the MEMS microphone package 103 is mounted). The sealing material 251 is dispensed in liquid form from a dispenser tip 253 at a location offset from the purposeful leak provided by the additional acoustic port 217 until the sealing material 251 forms a conformal coating encapsulating the entire package housing of the MEMS microphone package 103 and, in some implementations, one or more additional components mounted on the printed circuit board 201 (e.g., additional printed circuit board component 109). When properly applied, the encapsulant (i.e., the dispensed sealing material 251) will completely cover, but not completely penetrate, the additional acoustic port 217. Accordingly, when the encapsulant 251 is properly applied, the additional acoustic port 217 will be sealed and will not negatively affect the acoustic frequency response of the MEMS microphone. However, if the encapsulant 251 is not applied properly or completely, the additional acoustic port 217 will not be sealed and the acoustic frequency response of the MEMS microphone will be negatively affected.

In some implementations (such as in the example of FIGS. 2A, 2B, 2C, and 2D), the additional acoustic port 217 is formed in the package housing at a location at or near a maximum height of the MEMS microphone package 103 relative to the surface of the printed circuit board 201. Because the sealing material 251 is dispensed to a location on the printed circuit board 201, the sealing material 251 would need to completely encapsulate the entire package housing of the MEMS microphone package 103 before reaching the additional acoustic port 217. Accordingly, if a testing procedure confirms that the additional acoustic port 217 has been sealed by the encapsulant coating, then it can be assumed that the entire package housing of the MEMS microphone package 103 and, in some implementations, one or more additional printed circuit board components 109 outside of the MEMS microphone package 103 have also been appropriately sealed by the encapsulant coating.

Figure 3:
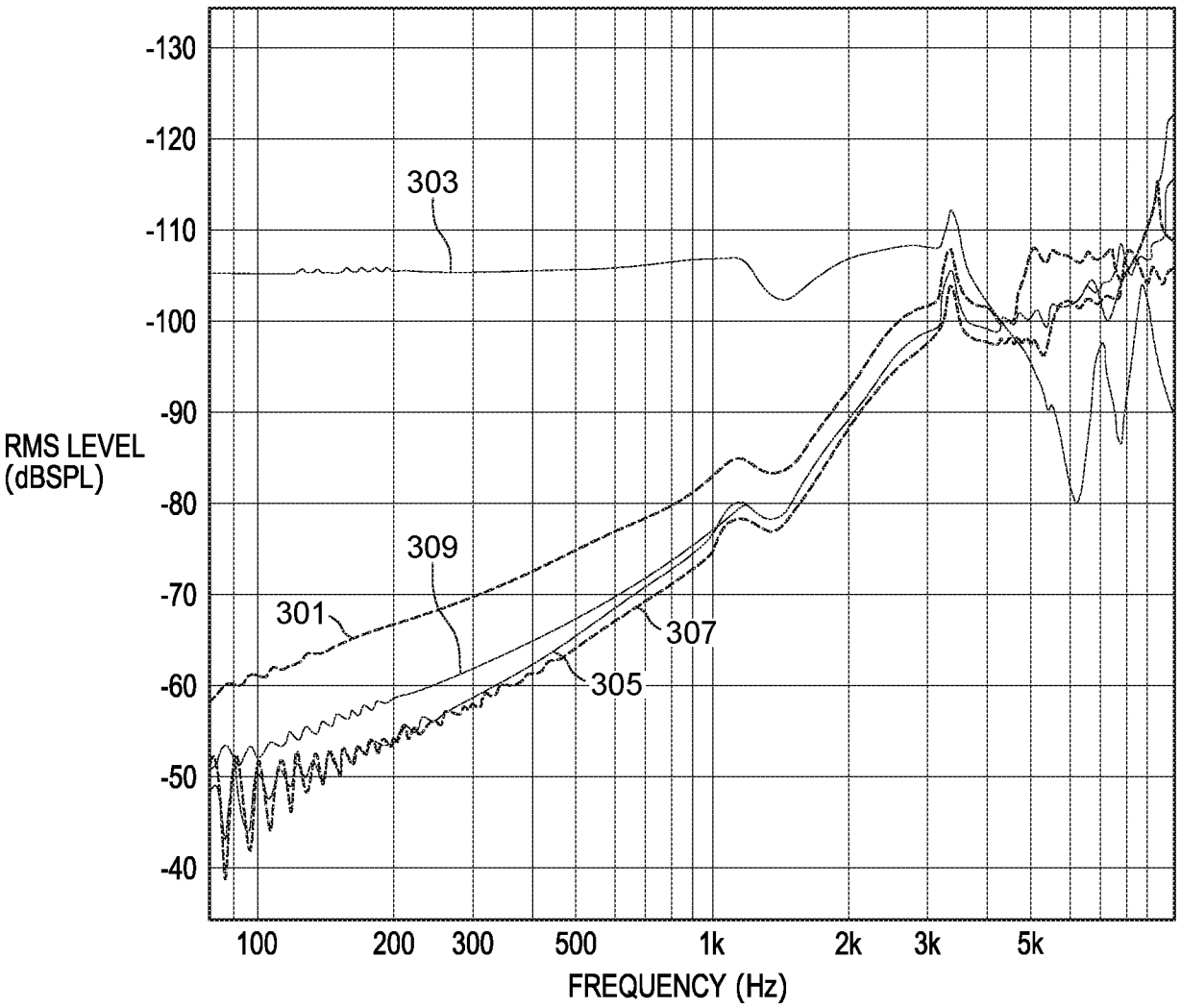
FIG. 3 is a graph comparing the acoustic frequency response of various different microphone packages including a microphone package with an additional top-port that provides a purposeful acoustic leak, that is properly sealed and several that are not properly sealed by the encapsulant.

For example, FIG. 3 illustrates a graph of the acoustic frequency response measured for five different microphone packages. The first frequency response curve 301 is measured for a bottom-ported MEMS microphone package in which the purposeful acoustic leak formed in the cap 205 is not completely sealed by the applied encapsulant coating. In contrast, the second frequency response curve 303 is measured for a bottom-ported MEMS microphone package in which the purposeful acoustic leak formed in the cap 205 is completely sealed by the encapsulant coating. For comparison, the third frequency response curve 305, the fourth frequency response curve 307, and the fifth frequency response curve 309 each correspond to a different microphone package where no encapsulant coating has been applied and the purposeful acoustic leak remains unobstructed.

As demonstrated by the graph of FIG. 3, when the purposeful acoustic leak provided by the additional acoustic port 217 is not completely sealed by the encapsulant material, the frequency response of the MEMS microphone package 103 is similar to the frequency response of a MEMS microphone package with the purposeful acoustic leak and without an applied encapsulant (e.g., frequency response curve 301 as compared to frequency response curves 305, 307, 309). However, when the additional acoustic port 217 is completely sealed by the encapsulant and the acoustic leak in the package housing has been sealed, the difference in the frequency response is quite significant. In the example of FIG. 3, there is a difference of over 35 dB between a MEMS microphone with an unsealed additional acoustic port 217 (i.e., frequency response curve 301) and a MEMS microphone with a sealed additional acoustic port 217 (i.e., frequency response curve 303). The graph of FIG. 3 also demonstrates that, once the purposeful acoustic leak is sealed by the encapsulant coating, the bottom-ported MEMS microphone package 103 provides a flat, wide-band acoustic sensitivity similar to the acoustic sensitivity of a similar bottom-ported MEMS microphone package without an additional acoustic port formed in the package housing.

In some implementations, the sealing material 251 is selected based on its viscosity, thixotropic, and/or surface tension properties as well as the surface energy properties of the package housing of the MEMS microphone package 103 and the printed circuit board 201 to ensure appropriate coverage and sealing coupling. Furthermore, in some implementations, the sealing material 251 and the size of the additional acoustic port 217 are selected to ensure that the sealing material 251 will cover the additional acoustic port 217 without fully penetrating the additional acoustic port 217. Accordingly, the viscosity, thixotropic, and/or surface tension properties can be leveraged to ensure that the sealing material does not partially or entirely fill the internal volume of the MEMS microphone package 103 when it is deposited as the conformal encapsulant.

Furthermore, in some implementations, the properties of the sealing material can be selectively tuned during the dispensing process. For example, the viscosity of the sealing material can be regulated or changed by controlling or adjusting a temperature of the sealing material (e.g., using heating elements incorporated into the dispensing system). Additionally or alternatively, the thixotropic properties of the sealing material can be regulated by applying a vibrational force to the sealing material prior to or during the dispensing process. In some implementations, the sealing material 251 is a two-part epoxy. However, in other implementations, the sealing material may include other types of material including, for example, silicone or putty.

Figure 2D:
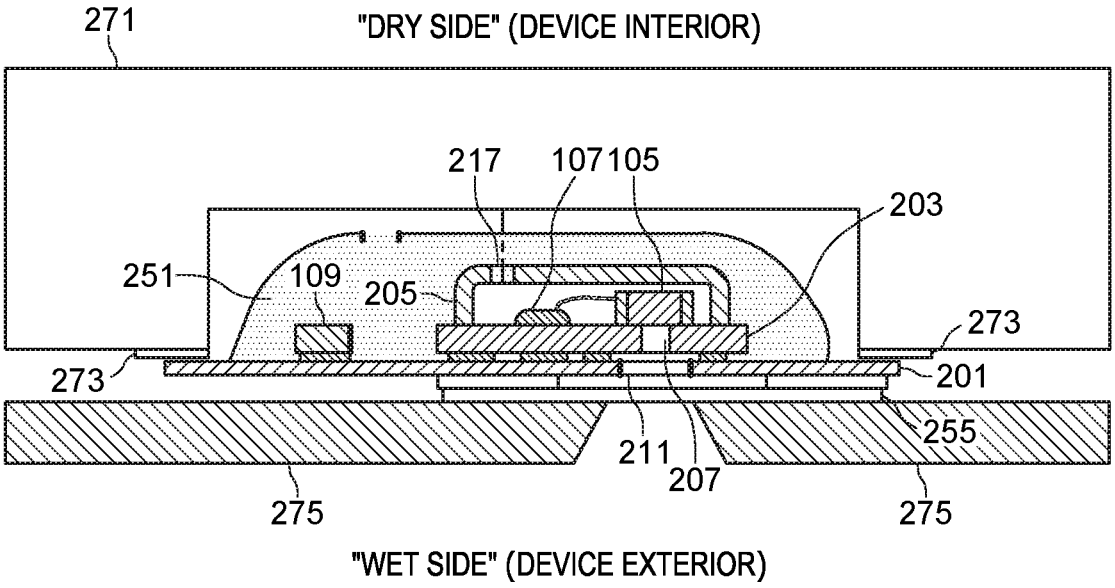
FIG. 2D is a cross-sectional elevation view of the encapsulant MEMS microphone package of FIG. 2C mounted external to a waterproof device housing.

As discussed above, the performance of a MEMS microphone can be improved by more closely positioning the MEMS microphone on or at an exterior of the electronic device. For electronic devices in which an environmental seal is necessary (e.g., "ruggedized" and/or waterproof electronic devices), the environmental seal provided by the encapsulant 251 to the bottom-ported MEMS microphone package 103 allows the bottom-ported MEMS microphone package 103 to be positioned external to a sealed interior volume of the electronic device 101. FIG. 2D illustrates one example of the encapsulated bottom-ported MEMS microphone package 103 mounted to an electronic device housing.

In the example of FIG. 2D, the printed circuit board 201 is coupled to the exterior of a sealed device housing 271 by an adhesive 273 (or, in some implementations, one or more screws or hardware fasteners) with the backside surface of the printed circuit board 201 facing the sealed device housing 271. In this example, the sealed device housing 271 provides a waterproof (or water resistant) environmental seal creating a "dry side" interior volume of the electronic device. However, the bottom-ported MEMS microphone package is positioned external to the sealed "dry side" interior volume of the electronic device. An aesthetic housing 275 is positioned on the "frontside" of the printed circuit board 201 to provide a more appealing visual appearance. In some implementations, the aesthetic housing 275, the adhesive 273, and/or the placement of the printed circuit board 201 against an exterior chamber configured to receive components mounted on the backside surface of the printed circuit board 201 may provide some degree of environmental protection for those component mounted on the backside surface of the printed circuit board 201. However, like the exterior surface of the aesthetic housing, the volume between the printed circuit board 201 and the aesthetic housing 275 and the volume between the printed circuit board 201 and the sealed device housing 271 are all on a "wet side" of the sealed device housing 271. Although the bottom-ported MEMS microphone package is not protected within the sealed interior volume of the electronic device provided by the sealed device housing 271, the configuration and placement illustrated in the example of FIG. 2D is still possible because the bottom-ported MEMS microphone package is instead protected by the environmental seal provided by the encapsulant 251.

Figure 4:
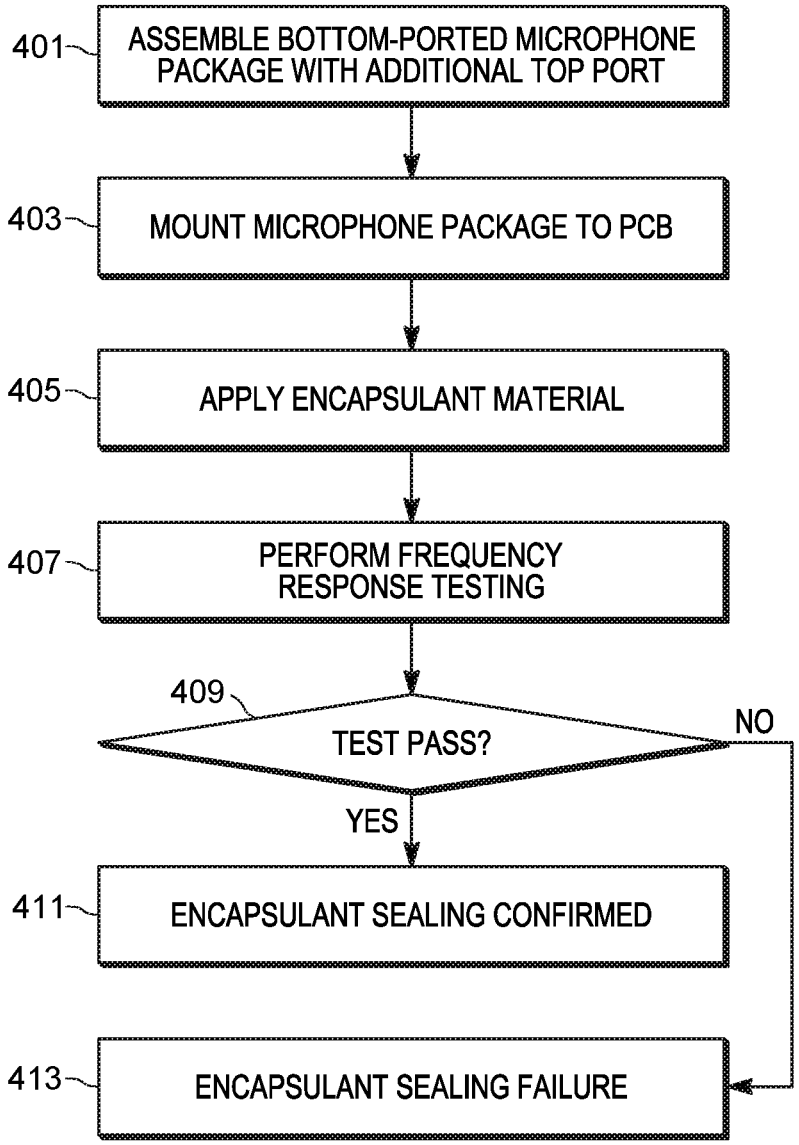
FIG. 4 is a flow chart of a method for applying and verifying the encapsulant seal using the system of FIG. 1.

FIG. 4 illustrates a method for assembling a device including a MEMS microphone package 103 sealed by an encapsulant as illustrated in the example of FIGS. 2A, 2B, 2C, and 2D and for using frequency response testing to verify the environmental seal provided by the encapsulant coating 251 to the bottom-ported MEMS microphone package 103. First, a bottom-ported microphone package 103 is assembled with an additional acoustic port 217 (step 401). The microphone package 103 is mounted to the printed circuit board 201 (step 403) and an encapsulant material 251 is applied to the printed circuit board 201 (step 405). After the encapsulant material 251 has been applied to form a conformal encapsulating coating on the "backside" of the microphone package 103, a frequency response testing is performed (step 407).

For example, an audio output of the device may be selectively coupled to an audio input of a test system 113 (as illustrated in FIG. 1). The test system 113 then generates an acoustic output 121 through a speaker (e.g., test system audio output 119) that excites the MEMS microphone membrane 105 through the primary acoustic port 207. In some implementations, the test system 113 is configured to controllably vary the frequency of the acoustic output 121 while monitoring the electrical output signal from the microphone package 103 and generates a graph showing the output response of the microphone as a function of frequency of the acoustic input. This measured frequency response is then compared to a reference signal (either an actual input signal provided as a second input to the test system controller 115 or a stored representation of a frequency response curve).

In some implementations, the reference signal is indicative of a frequency response of a microphone package that does not have an additional acoustic port 217 formed in the package housing (or a microphone package where the additional acoustic port 217 has been sealed by the encapsulant). In some such implementations, the test system 113 verifies the applied encapsulant coating (i.e., the device passes the test) if the electrical output signal received by the test system 113 from the MEMS microphone package 103 matches the reference signal (or one or more particular metrics of the reference signal) within a defined tolerance threshold. Conversely, the device under test has "failed" the test (indicating an incomplete or otherwise flawed encapsulant coating) when the difference between the electric output signal and the reference signal exceeds the defined tolerance threshold.

Additionally or alternatively, in some implementations, the reference signal is indicative of the frequency response of a MEMS microphone package where the additional acoustic port 217 is not sealed by an encapsulant coating. In some such implementations, the test system 113 is configured to determine that the encapsulant coating of the device under test has "failed" the test if the electrical output signal received by the test system 113 from the MEMS microphone package 103 matches the reference signal (or one or more particular metrics of the reference signal) within a defined tolerance threshold. Accordingly, the environmental seal of the microphone package is verified by the test system if the test is not failed (i.e., when a difference between the electrical output signal and the reference signal exceeds the defined tolerance threshold).

If the device 101 passes the frequency response testing (step 409), then the test system 113 is able to confirm that the encapsulant sealing has been applied to the MEMS microphone package 103 effectively (step 411). If the device 101 does not pass the frequency response testing (step 409), then the test system 113 indicates a failure of the encapsulant seal (step 413).

Although the examples described above discuss primarily a frequency response-based testing procedure, in some implementations, other types of verification testing may be performed on the device and/or the MEMS microphone package in addition to or instead of a frequency response-based test. For example, it may be desirable to perform other tests on the MEMS microphone package to verify other aspects of the microphone performance before the MEMS microphone package is mounted to the printed circuit board. In some such implementations, the presence of the additional acoustic port 217 on the package housing may also negatively affect the results of those other tests. Accordingly, in some implementations, a temporary seal is applied to the package housing to seal the additional acoustic port 217. This temporary seal is then removed before the sealing material is dispensed to form the conformal encapsulant coating.

Returning now to the example of FIG. 2C, a proper and complete application of the dispensing material 251 provides a protective (e.g., water-sealing) encapsulation of the "back-side" of the MEMS microphone package 103. Environmental protection of the "front-side" of the MEMS microphone package (i.e., the primary acoustic port 207) may be provided, for example, by positioning an air-permeable, water-resistant seal membrane 255 covering the acoustic port opening 211 of the printed circuit board 201 on the side of the printed circuit board 201 opposite the MEMS microphone package 103 as illustrated in the example of FIG. 2C.

As discussed above, the installation and configuration of the MEMS microphone package 103 as illustrated in the example of FIGS. 2A, 2B, and 2C may be incorporated, for example, into a portable electronic device such as a portable radio or a telephone. The back-side environmental protection can be beneficial to any "ruggedized" electronic device that is designed for regular exposure to environmental conditions such as water, vibration/impact, etc. Although the specific examples above describe a MEMS microphone package 103 that is mounted to a printed circuit board 201, the encapsulation application and verification can be utilized for microphone packages that are mounted to other surfaces. Similarly, the systems and methods described herein can be utilized for microphone packages mounted to flexible or ridged printed circuit boards.

Accordingly, the systems and methods described in the examples of this disclosure provide a process for applying an environmental seal to a back-side of a MEMS microphone package, a MEMS microphone package that is specifically designed for a testing procedure to verify the proper application of the back-side environmental seal, and a method for testing a device to verify the proper application of a back-side environmental seal to a MEMS microphone package.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has," "having," "includes," "including," "contains," "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a," "has . . . a," "includes . . . a," or "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially," "essentially," "approximately," "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more generic or specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment can be implemented as a computer-readable storage medium having computer readable code stored thereon for programming a computer (e.g., comprising a processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

We claim:

1. An electronic device comprising:

a printed circuit board;

a bottom-ported microphone package mounted to the printed circuit board, wherein the bottom-ported microphone package includes a primary acoustic port positioned adjacent to an acoustic port opening in the printed circuit board and an additional acoustic port formed through a package housing of the bottom-ported microphone package; and an encapsulant coating covering an exterior surface of the package housing of the bottom-ported microphone package, wherein the additional acoustic port is sealed by the encapsulant coating.

2. The electronic device of claim 1, wherein the encapsulant coating covers at least part of the printed circuit board providing an environmental seal on a backside of the bottom-ported microphone package, wherein the backside of the bottom-ported microphone package is a side of the printed circuit board to which the bottom-ported microphone package is mounted.

3. The electronic device of claim 1, wherein the encapsulant coating covers the additional acoustic port without completely penetrating the additional acoustic port.

4. An electronic device comprising:

a printed circuit board;

a bottom-ported microphone package mounted to the printed circuit board, wherein the bottom-ported microphone package includes a primary acoustic port positioned adjacent to an acoustic port opening in the printed circuit board and an additional acoustic port formed through the package housing of the bottom-ported microphone package;

an encapsulant coating covering an exterior surface of the package housing of the bottom-ported microphone package; and a device housing providing a watertight environmental seal for an interior volume of the electronic device, wherein the bottom-ported microphone package is coupled to the device housing at an exterior location outside of the sealed interior volume.

5. The electronic device of claim 4, wherein the printed circuit board is coupled to the device housing with the bottom-ported microphone package positioned between the printed circuit board and the device housing.

6. The electronic device of claim 4, further comprising a water-resistant seal membrane positioned on a frontside of the printed circuit board over the acoustic port opening in the printed circuit board, wherein the front side of the printed circuit board is a side of the printed circuit board opposite a backside of the printed circuit board, wherein the bottom-ported microphone package is mounted to the printed circuit board on the backside of the printed circuit board, and wherein the encapsulant coating provides a water-resistant seal for the bottom-ported microphone package on the backside of the printed circuit board.

7. An electronic device comprising:

a printed circuit board;

a bottom-ported microphone package mounted to the printed circuit board, wherein the bottom-ported microphone package includes a primary acoustic port positioned adjacent to an acoustic port opening in the printed circuit board and an additional acoustic port formed through a package housing of the bottom-ported microphone package; and an encapsulant coating covering an exterior surface of the package housing of the bottom-ported microphone package, wherein the encapsulant coating is a conformal coating formed by dispensing a sealing material in liquid form on the exterior surface of the package housing.

8. The electronic device of claim 7, wherein the additional acoustic port is not completely sealed by the encapsulant coating and provides an acoustic leak in the package housing of the bottom-ported microphone package.

9. The electronic device of claim 7, wherein the additional acoustic port is formed in the exterior surface of the package housing at a location of a maximum height of the bottom-ported microphone package relative to a surface of the printed circuit board to which the bottom-ported microphone package is mounted.

10. The electronic device of claim 7, wherein the encapsulant coating provides an environmental seal to the bottom-ported microphone package, the environmental seal being verifiable based on a comparison of a measured acoustic frequency response of the bottom-ported microphone package to a known acoustic frequency response indicative of a microphone package with a purposeful acoustic leak formed through the package housing.

11. The electronic device of claim 7, wherein the additional acoustic port is not completely sealed by the encapsulant coating and provides an acoustic leak in the package housing of the bottom-ported microphone package, and wherein a measured acoustic frequency response of the bottom-ported microphone package matches a known acoustic frequency response indicative of the microphone package with the purposeful acoustic leak formed through the package housing within a defined tolerance threshold.

12. The electronic device of claim 7, wherein the encapsulant coating provides an environmental seal to the bottom-ported microphone package, the environmental seal being verifiable based on a comparison of a measured acoustic frequency response of the bottom ported-microphone package to a known acoustic frequency response indicative of a microphone package without a purposeful acoustic leak through the package housing.

13. The electronic device of claim 12, wherein the additional acoustic port is sealed by the encapsulant coating, and wherein the measured acoustic frequency response of the bottom-ported microphone package matches the known acoustic frequency response indicative of the microphone package with the purposeful acoustic leak formed through the package housing within a defined tolerance threshold.

14. A method of verifying an environmental seal provided by the encapsulant coating to the bottom-ported microphone package in the electronic device of claim 7, the method comprising:

comparing a measured acoustic frequency response of the bottom-ported microphone package to a known acoustic frequency response indicative of a microphone package with a purposeful acoustic leak formed through the package housing; and determining whether the encapsulant coating has effectively sealed the additional acoustic port based on the comparison.

15. The method of claim 14, wherein determining whether the encapsulant coating has effectively sealed the additional acoustic port includes determining that the encapsulant coating has effectively sealed the additional acoustic port in response to determining that a difference between the measured acoustic frequency response and the known acoustic frequency response exceeds a defined tolerance threshold.

16. The method of claim 14, wherein determining whether the encapsulant coating has effectively sealed the additional acoustic port includes determining that the encapsulant coating has not effectively sealed the additional acoustic port in response to determining that the measured acoustic frequency response matches the known acoustic frequency response within a defined tolerance threshold.

17. A method of verifying an environmental seal provided by the encapsulant coating to the bottom-ported microphone package in the electronic device of claim 7, the method comprising:

comparing a measured acoustic frequency response of the bottom-ported microphone package to a known acoustic frequency response indicative of a microphone package without a purposeful acoustic leak through the package housing; and determining whether the encapsulant coating has effectively sealed the additional acoustic port based on the comparison.

18. The method of claim 17, wherein determining whether the encapsulant coating has effectively sealed the additional acoustic port includes determining that the encapsulant coating has effectively sealed the additional acoustic port in response to determining that the measured acoustic frequency response matches the known acoustic frequency response within a defined tolerance threshold.

19. The method of claim 17, wherein determining whether the encapsulant coating has effectively sealed the additional acoustic port includes determining that the encapsulant coating has not effectively sealed the additional acoustic port in response to determining that a difference between the measured acoustic frequency response and the known acoustic frequency response exceeds a defined tolerance threshold.

* * * * *